United States Patent [19]

Bouillon

[11] 4,141,277

[45] Feb. 27, 1979

[54] INSTALLATION FOR LAUNCHING MISSILES

[75] Inventor: Jean Bouillon, Coye la Foret, France

[73] Assignee: Creusot-Loire, Paris, France

[21] Appl. No.: 812,594

[22] Filed: Jul. 5, 1977

[30] Foreign Application Priority Data

Feb. 11, 1977 [FR] France ..... 77 03997

[51] Int. Cl.[2] ..... F41F 23/02

[52] U.S. Cl. ..... 89/38; 89/1.802; 89/1.815; 89/40 B

[58] Field of Search ..... 89/1.802, 1.815, 1.816, 89/38, 370, 40 B, 36 H, 41 E, 41 L

[56] References Cited

U.S. PATENT DOCUMENTS

| | | | |
|---|---|---|---|
| 1,309,483 | 7/1919 | Ludlow | 89/38 |
| 1,376,536 | 5/1921 | Gunn | 89/38 |
| 3,309,962 | 3/1967 | Lykam | 89/40 B X |
| 3,379,098 | 4/1968 | Zurbuchen | 89/40 B |
| 3,545,837 | 12/1970 | Chapman | 89/38 |
| 3,800,659 | 4/1974 | Kuiper | 89/38 X |
| 4,010,672 | 3/1977 | Kolbinger et al. | 89/1.802 |
| 4,019,422 | 4/1977 | Maghuson | 89/1.815 |

FOREIGN PATENT DOCUMENTS

| | | | |
|---|---|---|---|
| 2205826 | 8/1973 | Fed. Rep. of Germany | 89/38 |

*Primary Examiner*—David H. Brown
*Attorney, Agent, or Firm*—Haseltine, Lake & Waters

[57] ABSTRACT

An installation for launching missiles from an armored vehicle provided with a closed component for personnel and a periscopic sighting device, comprising a housing provided in the compartment, surrounding the sighting device and opening through a wall of the compartment, a launching ramp mounted on a lifting mechanism operable to move the ramp between a firing position outside the housing and a retracted position in which the ramp and lifting mechanism are located within the housing, and a closure for closing the opening of the housing when the ramp is in its retracted position, the closure then lying in extension of the wall of the compartment. A rotatable support mechanism for the lifting mechanism is provided in the housing and surrounds the sighting device such that the ramp is rotatable around the sighting device at least in the firing position thereof.

3 Claims, 5 Drawing Figures

73
74
71
7
86
710
51
8
81
64
6
83'
60
5
52
1
3
II
II 710
75
86
80
74
73
71
7
72
5
87
88
83'
84
83
82
85
8
81
6
1
I
I

INSTALLATION FOR LAUNCHING MISSILES

FIELD OF THE INVENTION

The present invention relates to an installation for launching missiles from an armored vehicle.

Various types of armored vehicles exist which are particularly used for the transport of material or personnel, or which are equipped with armaments. In order to diminish the risks to which the personnel might be subject in contaminated regions, the compartment of the vehicle occupied by the personnel may be put under increased pressure with respect to the exterior pressure. It is also useful to provide vehicles, which, by means of small modifications, may be used for the different purposes mentioned above, e.g. transport of personnel, transport of materials, or support for arms of different types, and which allow the use of armaments, while at the same time providing protection for the personnel with respect to light arms and contamination risks.

French Pat. No. 2,301,797 describes such an installation which includes at least one ramp, optionally a double ramp, for launching missiles, mounted on a lifting support which makes it possible to withdraw the ramp into the inside of a housing. The whole unit is placed inside an enclosure, the ramp being mounted on a plate which forms a door for closing the housing and which, in the withdrawn position of the ramp, is located in extension of the wall of the vehicle.

In the installation described in the French Pat. No. 2,301,797, the vehicle is provided with a telescopic sighting device located at the side of the ramp. However the azimuthal orientation of the ramp is limited by the presence of the periscopic sighting device, and the presence of the ramps may upset sighting by masking certain angles.

SUMMARY OF THE INVENTION

It is an object of the present invention to provide an installation which makes it possible to overcome this disadvantage and to orientate the ramp azimuthally through 360° if desired by doing away with dead angles.

It is a further object of the invention to provide an installation for launching a missile from an armored vehicle having a closed compartment for personnel, the installation comprising:

a housing located in the compartment and having an opening which opens in a wall of said compartment;

a launching ramp;

lifting means for moving said launching ramp through said opening between a firing position outside said housing and a retracted position in which said launching ramp and lifting means are within said housing;

means for controlling movement of said lifting means;

a closure for the opening of said housing which is in closed position when said launching ramp is in its retracted position, said closure in said closed position being substantially in extension of said wall of said compartment;

a periscopic sighting device arranged to be extendable through said wall of said compartment;

said housing extending about said periscopic sighting device;

support means in said housing for said lifting means; and means mounting said support means for rotation within said housing about said sighting device for rotating said ramp about said sighting device at least in said elevated firing position.

Preferably, the lifting means comprises two arms arranged about the sighting device and which are articulated on a horizontal axis on said rotatable support means which is rotatable via the intermediary of rolling elements along a circular path which surrounds said sighting device.

The invention will be more fully understood from the following description of an embodiment thereof, given by way of example only, and illustrated in the accompanying drawings.

DETAILED DESCRIPTION

Figure 1:
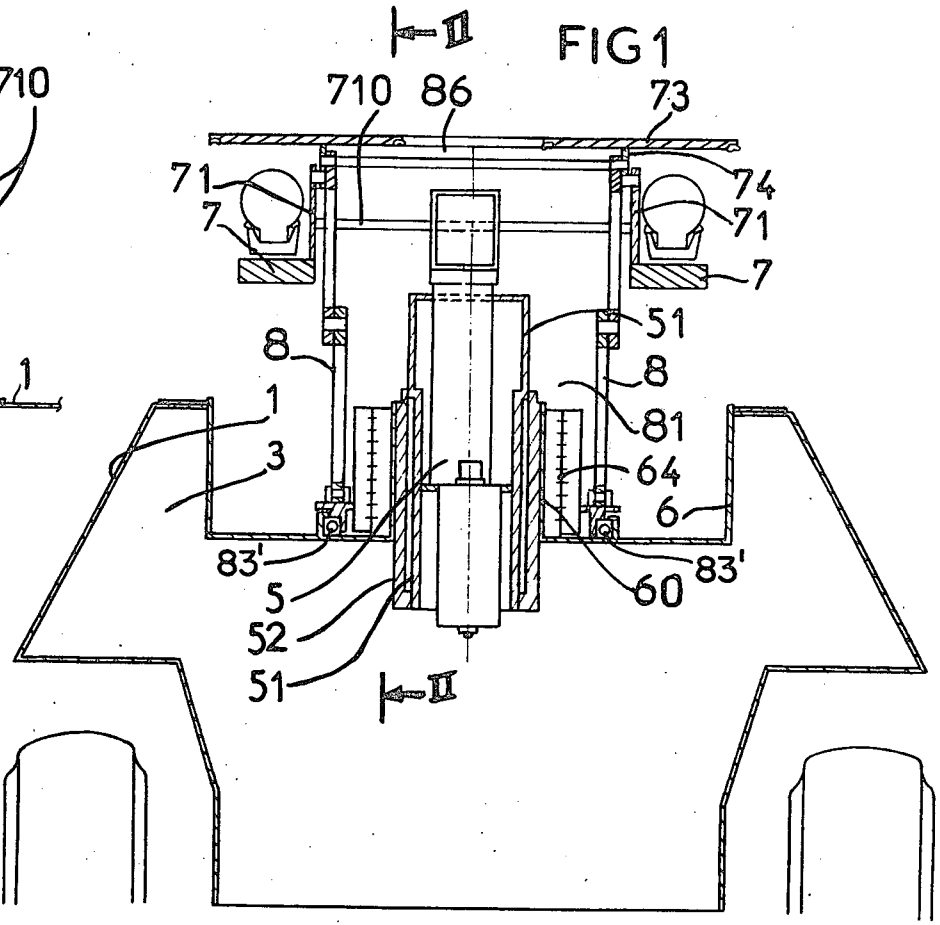
FIG. 1 shows a transverse section of a vehicle including an embodiment of an installation according to the present invention, the ramps being in their extended firing positions and inclined to the horizontal.
Figure 2:
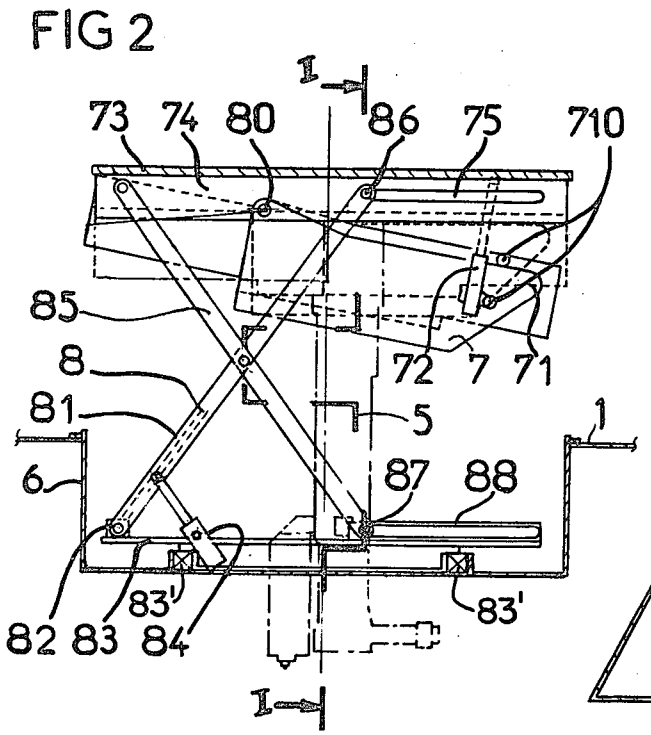
FIG. 2 is a longitudinal section taken along line II—II in FIG. 1, the ramps being in their extended firing position but horizontal.
Figure 4:
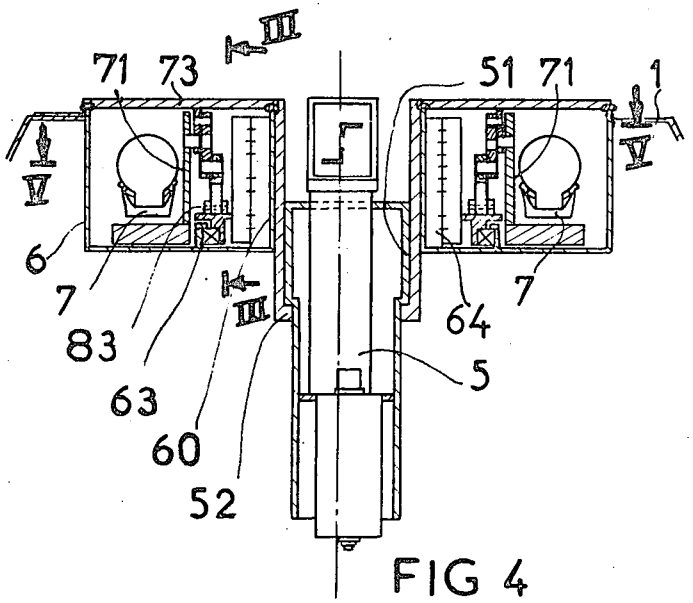
FIG. 4 is a transverse section through the installation with the ramps in retracted position.
Figure 3:
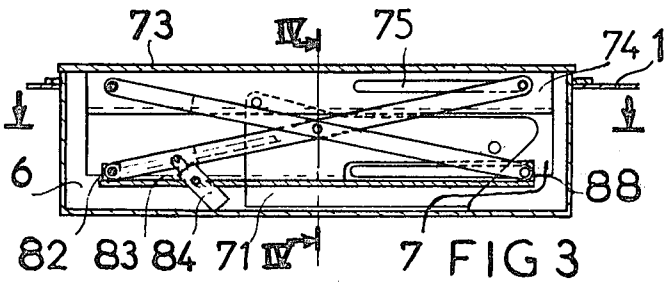
FIG. 3 is a longitudinal section through the installation of FIG. 1 but with the ramps in retracted position.
Figure 5:
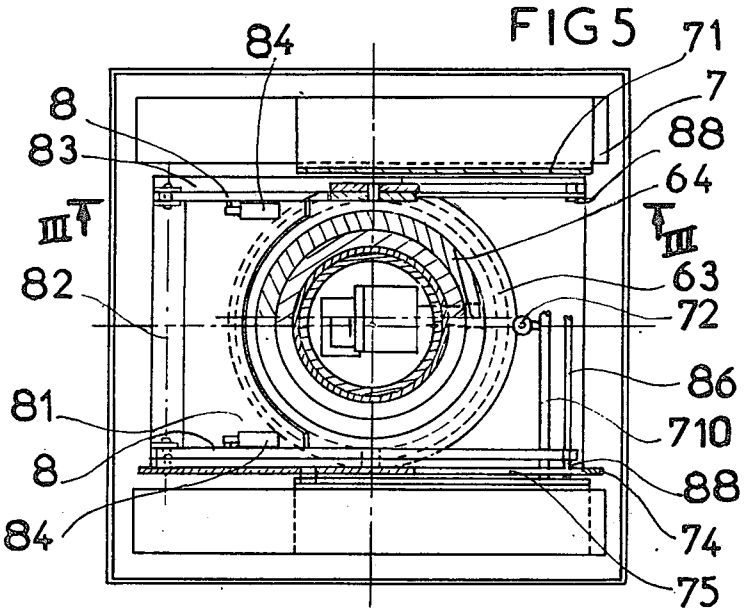
FIG. 5 is a horizontal section taken along line V—V in FIG. 4.

As in the installation of French Pat. No. 2,301,797, the present installation shown in the drawings is mounted on a vehicle comprising a chassis 1 in the interior of which there is an enclosure 3 which is generally sealed and forms a compartment for personnel which is under a pressure greater than the exterior pressure.

The enclosure 3 is provided with an observation cupola which is not shown and a periscopic sighting device 5.

In the embodiment shown, the installation includes two single ramps 7 which are located one on each side of the sighting device 5 and which can be retracted into a single housing 6. The housing is constituted by a rectangular box whose length and width are sufficient for retracting the ramps together, taking into account the length of the latter and their spacing. At the centre of the box 6 a cylindrical wall 60 is located which forms a passage for the sighting device 5.

The ramps 7 are supported by a single lifting support comprising two arms 8 which embrace the sighting device 5 and which may be folded inside the housing 6. For this purpose, the two arms 8, which are connected by a sheet metal brace 81, are articulated at their lower ends about a horizontal axis 82 on a plate 83. One or two jacks 84 whose body is articulated to the plate 83 and whose piston rod is connected to one of the arms 8 controls the raising or lowering of the arms 8.

The launching ramps 7 are fixed on an upper plate 73 which constitutes a closure member which comes into contact with the upper part of the housing 6, when the ramps are retracted. This single plate 73 which covers the whole of the opening of the housing 6 is fixed on the lifting support so as to remain horizontal when the arms 8 are raised. For this purpose, each arm 8 is associated with a tie arm 85 which forms with the arm 8 an articulated scissor-like lever system which may be folded into the housing. The upper ends of the arms 8 are connected by a horizontal rod 86 which is slidable in elongated slots 75 which are provided in two vertical walls 74 fixed to the lower face of the closure plate 73, he slots 75 being parallel to the direction of the ramps 7. The two tie rods 85 are articulated at their center to the arms 8 and at their upper ends to a respective vertical wall 74. Each tie rod 85 is provided at its lower part with a head 87 which is slidable in a rectilinear guide 88 fixed to the plate 83. In this way, the upper plate 73 remains parallel to the plate 83 when the cross formed by the arms 8 and the tie rods 85 is opened by means of the jack 84. If the rod 86 and the heads 87 are moved to their limit positions defined by the ends of the slot 75 and guide 88, play is automatically taken up and the walls 74 and the plate 73 are fixed in a position which is perfectly stable.

A wall 71 to which a respective ramp 7 is fixed is articulated on each wall 74 about an axis 80 and wall 71 extends parallel to the respective wall 74.

A jack 72, one part of which is fixed to a rod 710 which connects the walls 71 and the other part of which is articulated to plate 73, determines the angle of aim of the two ramps.

The upper plate 73 which constitutes a closure member for the housing 6 has a rectangular shape and is provided with an orifice at its center for the passage of the sighting device 5. In the withdrawn position of the ramps, plate 73 comes into contact, optionally via the intermediary of seals, with the upper edges of the housing 6 and of the shaft 60, and, in this position, it lies in extension of the upper wall of the chassis 1.

The support plate 83 also has a rectangular shape and is provided with an orifice for the passage of the shaft 60 of the sighting device. The plate 83 rests, via the intermediary of roller members 83' of a known type, on a circular track 63 which surrounds the shaft 60, and which makes possible the rotation of the unit consisting of the ramps 7, the supporting arms 8 and the plate 83 about the sighting device for azimuthal aim. This aim can be controlled by a pinion which engages with a toothed circular crown which is rigidly fixed to the plate 83, which is the conventional arrangement and is not shown.

For transmitting elevational aiming instructions to the launching ramps, if the azimuthal aim is limited on both sides of the longitudinal axis, it is possible to use a simple flexible cable. On the other hand, if it is desired to freely orientate the ramps through 360° around the sighting device, the information can be transmitted by a rotating joint 64 comprising two concentric elements, one of which is rigidly fixed to the shaft 60 and the other to the plate 83.

It may be useful to have the possibility of completely retracting the sighting device within the vehicle. For this purpose, as has been shown in the drawings, the sighting device may be placed inside a tube 51 which forms the piston of a jack whose cylinder 52 is rigidly fixed to the shaft 60. The axis of the tube 51 passes through the center of the housing 6 and its diameter should be sufficient for it to accommodate the periscopic sighting device 5. Taking into account the shape of the latter, the optical axis of sighting is located close to the axis of the housing 6 but does not necessarily coincide with it.

Thus, with use of the provisions which have been described above, the vehicle may be provided with a double ramp which can be orientated in all directions around the sighting device. Obviously, the two arms 8 should be located at a sufficient distance from the sighting device to allow for the orientation of the ramps. Thus, the installation is particularly compact while allowing aim in all directions. Furthermore, because of the possibility of vertical displacement of the sighting device, the sighting device may be positioned above the ramps, which, hence, do not mask sighting.

Because it is possible to retract the ramps and the sighting device totally inside the vehicle, the vehicle may be provided with a commonplace appearance when the housing 6 is closed by the upper closure plate 73.

The invention is obviously not limited to the details of the embodiment which has just been described, but embraces variations and particularly those which only differ by the employment of equivalent means.

For example, in the above described embodiment, the rectangular shape of the housing makes it necessary to place the ramps in a direction which is parallel to the longitudinal axis of the housing in order to withdraw them inside the housing. This arrangement is the most common, since the ramps are placed as in the installation of French Pat. No. 2,301,797, in the elongation of the loading slide, the housing 6 being provided with doors for the passage of new missiles. However, it is also possible to provide the housing 6 with a circular shape, making it possible to retract the ramps without concern for their orientation, the unit could then be placed parallel to the longitudinal axis, even when the ramps are retracted, if the dimensions of the housing are sufficient.

Moreover, while a lifting support having articulated arms has been shown, which is particularly simple and effects automatic take-up of play, it could obviously be replaced by any other lifting means which can be folded inside the housing.

It will also be clear two double ramps placed one on either side of the sighting device could be used by making slight modifications to the device, such an arrangement having been described in French Pat. No. 2,301,797.

On the other hand, the device could be used with a single ramp placed on one side of the sighting device. In this case, the housing 6 could comprise an elongated part in which the ramp and the lifting support are accommodated in a folded state and an annular part surrounding the sighting device.

What is claimed is:

1. An installation for launching a missile from an armored vehicle having a closed compartment for personnel, the installation comprising:

a housing located in the compartment and having an opening which opens in a wall of said compartment;

a launching ramp;

lifting means for moving said launching ramp through said opening between a firing position outside said housing and a retracted position in which said launching ramp and lifting means are within said housing;

means for controlling movement of said lifting means;

a closure for the opening of said housing which is in closed position when said launching ramp is in its retracted position, said closure in said closed position being substantially in extension of said wall of said compartment;

a periscopic sighting device arranged to be extendable through said wall of said compartment;

said housing extending about said periscopic sighting device;

support means in said housing for said lifting means; and means mounting said support means for rotation within said housing about said sighting device for rotating said ramp about said sighting device at least in said elevated firing position;

said lifting means comprising two arms arranged about said sighting device and articulated about a horizontal axis on said rotatable support means, said rotatable support means being movable on rolling bodies in a circular path surrounding said sighting device.

2. An installation according to claim 1, wherein each of said arms forms part of an articulated lever system which is foldable into said housing in said retracted position of said ramps.

3. An installation according to claim 1, including two launching ramps placed one on either side of said sighting device and mounted on a respective one of said arms of said lifting means, wherein said housing provides a single chamber in the center of which a cylindrical passage is provided for the sighting device, the closure is constituted by a single plate which extends over said ramps and acts as a connecting cross-piece between said ramps, said plate being provided with an orifice whose periphery is applied, in said closed position, to an upper part of said cylindrical passage.

* * * * *